US009411280B2

(12) United States Patent
Samei

(10) Patent No.: US 9,411,280 B2
(45) Date of Patent: Aug. 9, 2016

(54) FIXING DEVICE AND IMAGE FORMING APPARATUS INCORPORATING SAME

(71) Applicant: Masahiro Samei, Osaka (JP)

(72) Inventor: Masahiro Samei, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/254,022

(22) Filed: Apr. 16, 2014

(65) Prior Publication Data

US 2014/0314459 A1 Oct. 23, 2014

(30) Foreign Application Priority Data

Apr. 19, 2013 (JP) ..... 2013-088663
Mar. 31, 2014 (JP) ..... 2014-072640

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2003
USPC ..... 399/330, 335
See application file for complete search history.

(56) References Cited

U.S. PATENT DOCUMENTS 6,336,009 B1 * 1/2002 Suzumi ..... G03G 15/2042 399/67
2008/0099864 A1 * 5/2008 Wu et al. ..... 257/432
2009/0245900 A1 * 10/2009 Kagawa ..... 399/329
2012/0076521 A1 * 3/2012 Ishihara ..... G03G 15/553 399/33

FOREIGN PATENT DOCUMENTS

JP 6-95540 4/1994
JP 2001-343860 12/2001
JP 2010-091665 4/2010
JP 2011-209409 10/2011
JP 2012-030439 2/2012

* cited by examiner

*Primary Examiner* — Clayton E Laballe
*Assistant Examiner* — Noam Reisner
(74) *Attorney, Agent, or Firm* — Oblon, McClelland, Maier & Neustadt, L.L.P.

(57) ABSTRACT

A fixing device includes a first rotator, a second rotator pressed against the first rotator, and a heater to heat the first rotator. The heater includes an elongated substrate extending in an axial direction of the first rotator, a heat generator disposed on a surface of the substrate facing the first rotator, at a position downstream in a rotational direction of the first rotator, a plurality of first conduction paths connected to the heat generator and grounded downstream of the heat generator in the rotational direction of the first rotator, and a second conduction path on which the plurality of first conduction paths are grounded. The heat generator has a heat-generating area divided into a plurality of sub-heat-generating areas in the axial direction of the first rotator. The plurality of sub-heat-generating areas are grounded on the second conduction path via the plurality of first conduction paths.

10 Claims, 9 Drawing Sheets

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2013-088663, filed on Apr. 19, 2013, and 2014-072640, filed on Mar. 31, 2014, in the Japan Patent Office, the entire disclosures of which are hereby incorporated by reference herein.

BACKGROUND

1. Technical Field

Embodiments of this disclosure generally relate to a fixing device and to an electrophotographic image forming apparatus incorporating the fixing device.

2. Related Art

Some typical heating devices include a heat-resistant film, a heat generator and a pressure member. The heat generator is fixedly supported at the center in a lateral direction on one side of a heater substrate and divided into six sub-heat generators in a direction perpendicular to a direction in which a recording medium is conveyed. The pressure member is disposed facing the heat generator via the heat-resistant film. The pressure member and the heat generator are pressed against each other via the heat-resistant film to form an area of contact referred to herein as a fixing nip therebetween. The recording medium is conveyed to the fixing nip, between the heat-resistant film and the pressure member, thereby passing through the fixing nip together with the heat-resistant film. Thus, heat energy is transmitted from the heat generator to the recording medium via the heat-resistant film.

Such heating devices are capable of significantly reducing energy consumption by selectively supplying power to the sub-heat generators for individually heating their respective images, thereby reaching a fixing temperature.

In addition, the heating devices include electrical conduction paths to supply power to the heat generator. The electrical conduction paths are provided, e.g., in a substantially symmetrical manner, on both sides of the heater substrate in the lateral direction thereof with the six sub-heat generators interposed therebetween.

Some other typical heating devices, specifically image heating devices, include a heating rotator to heat an image carried by a recording medium, and a heating member to contact and heat the surface of the heating rotator. The heating member includes a heater having a heat generator on a heat-conductive substrate, and a heat-conductive member that contacts the substrate. The heat-conductive member is made of a material having a higher heat conductivity than a material of the substrate. Thus, the typical image heating devices have a heating area allowing both of the heater and the heat-conductive member to heat the surface of the heating rotator.

With such a configuration, the typical image heating devices can shorten warm-up time and lower the temperature of the heater.

Some of them also include substantially one heat generator disposed at a position downstream in a rotational direction of a fixing roller in the heating area.

However, with such a typical wiring pattern, in which electrical conduction paths are disposed on both sides of the heater substrate in the lateral direction thereof, with the heat generator interposed therebetween in a substantially symmetrical manner, a space, that is, a line width of wiring is insufficient to dispose the heat generator having a plurality of heat-generating areas, at a position closer to the fixing nip.

SUMMARY

In one embodiment of this disclosure, an improved fixing device for fixing an unfixed toner image formed on a recording medium onto the recording medium under heat and pressure in a fixing nip includes a first rotator, a second rotator pressed against the first rotator to form the fixing nip, and a heater to heat the first rotator. The heater includes an elongated substrate extending in an axial direction of the first rotator, a heat generator disposed on a surface of the substrate facing the first rotator, at a position downstream in a rotational direction of the first rotator, a plurality of first conduction paths connected to the heat generator and grounded downstream of the heat generator in the rotational direction of the first rotator, and a second conduction path on which the plurality of first conduction paths are grounded. The heat generator has a heat-generating area divided into a plurality of sub-heat-generating areas in the axial direction of the first rotator. The plurality of sub-heat-generating areas are grounded on the second conduction path via the plurality of first conduction paths.

In another embodiment of this disclosure, an improved fixing device for fixing an unfixed toner image formed on a recording medium onto the recording medium under heat and pressure in a fixing nip includes a first rotator, a second rotator pressed against the first rotator to form a fixing nip, and a heater to heat the first rotator. The heater includes an elongated substrate extending in an axial direction of the first rotator, a heat generator disposed on a surface of the substrate facing the first rotator, at a position downstream in a rotational direction of the first rotator, and a plurality of conduction paths connected to the heat generator and grounded downstream of the heat generator in the rotational direction of the first rotator. The elongated substrate has a plurality of through-holes. The heat generator has a heat-generating area divided into a plurality of sub-heat-generating areas in the axial direction of the first rotator. The plurality of conduction paths are wired on a backside of the elongated substrate via the through-holes and grounded.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
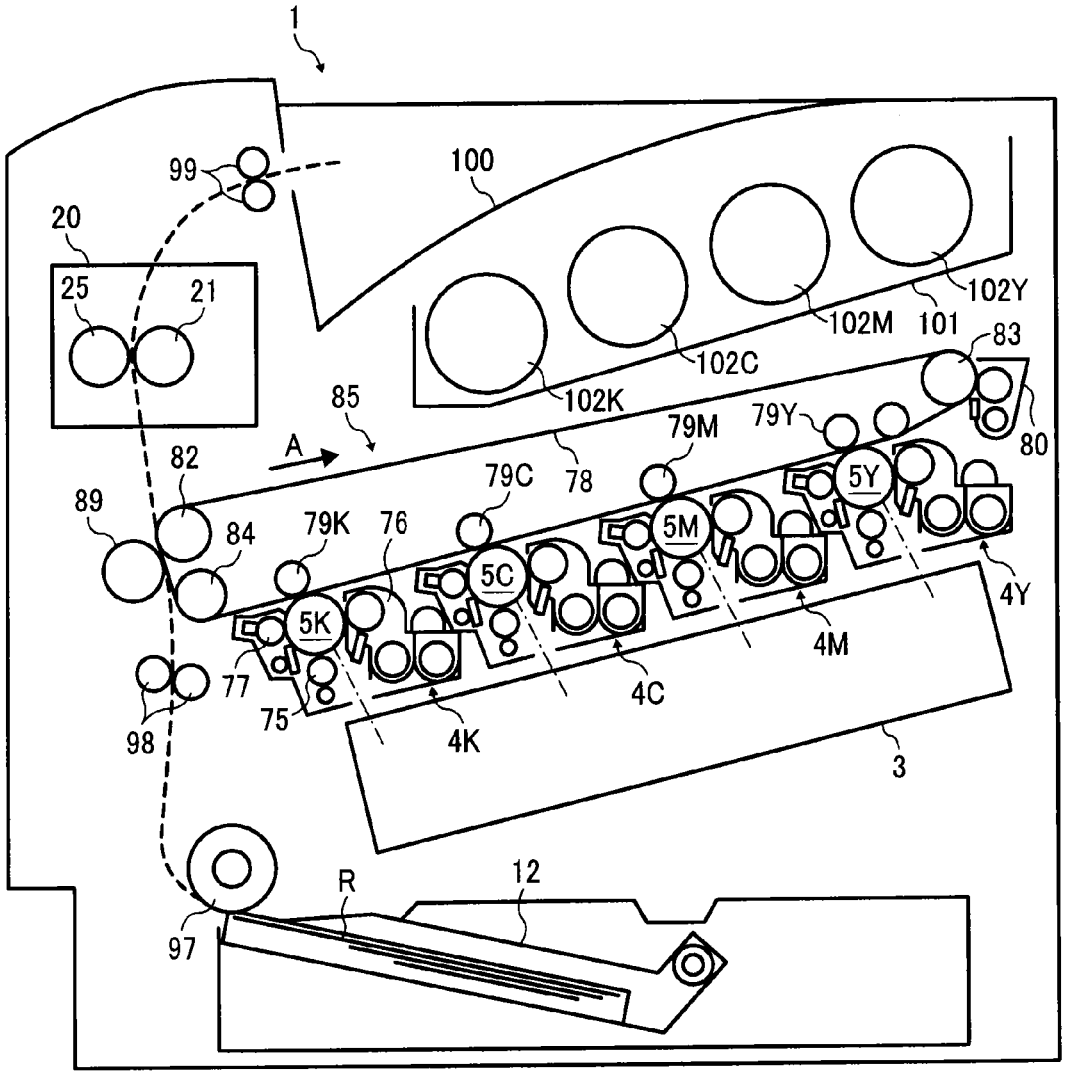
FIG. 1 is a schematic overall view of an image forming apparatus according to embodiments of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals are given to identical or corresponding constituent elements such as parts and materials having the same functions, and redundant descriptions thereof omitted unless otherwise required.

Referring now to the drawings, wherein like reference numerals designate identical or corresponding parts throughout the several views, embodiments of this disclosure are described below.

Initially with reference to FIG. 1, a description is given of an overall configuration and operation of an image forming apparatus 100 according to some embodiments of this disclosure.

FIG. 1 is a schematic overall view of the image forming apparatus 1 according to some embodiments of this disclosure.

It is to be noted that, in the following description, suffixes Y, M, C, and K denote colors yellow, magenta, cyan, and black, respectively, and may be omitted where unnecessary.

As illustrated in FIG. 1, the image forming apparatus 1 of this embodiment is a tandem-type color printer. A bottle container 101 is disposed in an upper portion of the image forming apparatus 1. The bottle container 101 accommodates four removable toner bottles 102Y, 102M, 102C, and 102K. The toner bottles 102Y, 102M, 102C, and 102K accommodates toner of yellow, magenta, cyan, and black, respectively. Thus, the four toner bottles 102Y, 102M, 102C, and 102K are replaceable.

An intermediate transfer unit 85 is disposed below the bottle container 101. The intermediate transfer unit 85 includes, e.g., an intermediate transfer belt 78, four primary-transfer bias rollers 79Y, 79M, 79C, and 79K, a secondary-transfer backup roller 82, a cleaning backup roller 83, a tension roller 84, and an intermediate transfer cleaner 80.

Four imaging units 4Y, 4M, 4C, and 4K are arranged side by side, facing the intermediate transfer belt 78 to form toner images of yellow, magenta, cyan, and black, respectively.

The four imaging units 4Y, 4M, 4C, and 4K include photoconductive drums 5Y, 5M, 5C, and 5K, respectively. The photoconductive drums 5Y, 5M, 5C, and 5K serve as image carriers. Each of the photoconductive drums 5Y, 5M, 5C, and 5K is surrounded by various pieces of imaging equipment, such as a charging device 75, a developing device 76, a cleaning device 77, and a charge neutralizing device. Imaging processes, namely, charging, exposure, development, transfer, and cleaning processes are performed on each of the photoconductive drums 5Y, 5M, 5C, and 5K. Accordingly, the toner images of yellow, magenta, cyan, and black are formed on the photoconductive drums 5Y, 5M, 5C, and 5K, respectively.

The photoconductive drums 5Y, 5M, 5C, and 5K are rotated in a counterclockwise direction in FIG. 1 by a driving motor. Surfaces of the photoconductive drums 5Y, 5M, 5C, and 5K are uniformly charged where the surfaces of the photoconductive drums 5Y, 5M, 5C, and 5K face the respective charging devices 75 (charging process). Then, as the photoconductive drums 5Y, 5M, 5C, and 5K rotate and reach a position opposite an exposure device 3, the surfaces of the photoconductive drums 5Y, 5M, 5C, and 5K are scanned with and exposed by laser light L emitted from the exposure device to form electrostatic latent images of yellow, magenta, cyan and black on the photoconductive drums 5Y, 5M, 5C, and 5K, respectively (exposure process).

Then, the photoconductive drums 5Y, 5M, 5C, and 5K rotate further and reach a position at which the surfaces of the photoconductive drums 5Y, 5M, 5C, and 5K face the respective development devices 76, where the electrostatic latent images are developed with toner of yellow, magenta, cyan and black into visible images, also known as toner images of yellow, magenta, cyan and black, respectively (development process). Then, the photoconductive drums 5Y, 5M, 5C, and 5K rotate further and reach a position at which the surfaces of the photoconductive drums 5Y, 5M, 5C, and 5K face primary transfer bias rollers 79Y, 79M, 79C, and 79K, respectively, via the intermediate transfer belt 78, where the toner images are transferred from the photoconductive drums 5Y, 5M, 5C, and 5K onto the intermediate transfer belt 78 (primary-transfer process). At this time, a small amount of toner may remain untransferred on the surfaces of the photoconductive drums 5Y, 5M, 5C, and 5K as residual toner.

Then, the photoconductive drums 5Y, 5M, 5C, and 5K rotate further and reach a position at which the surfaces of the photoconductive drums 5Y, 5M, 5C, and 5K face the respective cleaning devices 77, where the cleaning devices 77 mechanically collect the residual toner on the surfaces of the photoconductive drums 5Y, 5M, 5C, and 5K with cleaning blades incorporated in the cleaning devices 77, respectively (cleaning process).

Finally, the photoconductive drums 5Y, 5M, 5C, and 5K rotate and reach a position at which the surfaces of the photoconductive drums 5Y, 5M, 5C, and 5K face the respective charge neutralizing devices, where residual potential is removed from the surfaces of the photoconductive drums 5Y, 5M, 5C, and 5K.

Thus, a series of image forming processes performed on the surfaces of the photoconductive drums 5Y, 5M, 5C, and 5K is completed.

After the series of image forming processes, the toner images formed on the surfaces of the photoconductive drums 5Y, 5M, 5C, and 5K through the development process are transferred onto the intermediate transfer belt 78 while being superimposed one atop another to form a multicolor toner image on the intermediate transfer belt 78.

The intermediate transfer belt 78 is stretched over the secondary-transfer backup roller 82, the cleaning backup roller 83, and the tension roller 84, and rotated in a direction indicated by arrow A in FIG. 1 by rotation of the secondary-transfer backup roller 82.

The four primary transfer bias rollers 79Y, 79M, 79C, and 79K and the photoconductive drums 5Y, 5M, 5C, and 5K press against each other to form areas of contact via the intermediate transfer belt 78 herein called primary transfer nips, respectively. Each of the primary transfer bias rollers 79Y, 79M, 79C, and 79K is applied with a transfer bias having a polarity opposite a polarity of toner.

The intermediate transfer belt 78 travels in the direction indicated by arrow A and successively passes through the primary transfer nips formed between the primary transfer bias rollers 79Y, 79M, 79C, and 79K, on the one hand, and the photoconductive drums 5Y, 5M, 5C, and 5K, respectively, on the other. Thus, the toner images formed on the respective photoconductive drums 5Y, 5M, 5C, and 5K are primarily transferred onto the intermediate transfer belt 78 while being superimposed one atop another.

Then, the intermediate transfer belt 78 carrying the multicolor toner image reaches a position at which the intermediate transfer belt 78 faces the secondary transfer roller 89, where the secondary transfer backup roller 82 and the secondary transfer roller 89 press against each other to form an area of contact via the intermediate transfer belt 78, herein called a secondary transfer nip.

The multicolor color toner image formed on the intermediate transfer belt 78 is transferred onto a recording medium R at the secondary transfer nip. At this time, a small amount of toner may remain untransferred on the intermediate transfer belt 78 as residual toner. Then, the intermediate transfer belt 78 reaches a position at which the intermediate transfer belt 78 faces the intermediate transfer cleaner 80. At the position, the residual toner on the intermediate transfer belt 78 is collected.

Thus, a series of transfer processes performed on the intermediate transfer belt 78 is completed.

Now, a detailed description is given of movement of the recording medium R. The recording medium R is fed by a sheet tray 12 disposed in a lower portion of the image forming apparatus 1, and conveyed to the secondary transfer nip via a feed roller 97 and a pair of registration rollers 98 pressed against each other. Specifically, the sheet tray 12 accommodates a stack of recording media R, such as transfer sheets, one atop another.

When the feed roller 97 is rotated in a counterclockwise direction in FIG. 1, an uppermost recording medium R of the plurality of recording media R is fed toward an area of contact of rollers of the pair of registration rollers 98.

The recording medium R conveyed to the pair of registration rollers 98 temporarily stops at a predetermined position as the pair of registration rollers 98 stops rotating.

The pair of registration rollers 98 is rotated again to convey the recording medium R to the secondary transfer nip in synchronization with the movement of the intermediate transfer belt 78 carrying the multicolor toner image. Thus, the multicolor toner image is transferred onto the recording medium R.

Thereafter, the recording medium R carrying the multicolor toner image is conveyed to a fixing device 20, described later. In the fixing device 20, the multicolor toner image is fixed onto the recording medium R under heat and pressure applied by an endless fixing belt 21 and a pressing roller 25.

Then, the recording medium R passes through rollers of a pair of output rollers 99 pressed against each other, and is discharged onto an output tray 100 outside the image forming apparatus 1.

Thus, the plurality of recording media R carrying output images rest one atop another on the output tray 100. Accordingly, a series of image forming processes performed in the image forming apparatus 1 is completed.

Referring now to FIGS. 2 to 5, a detailed description is given of the fixing device 20 according to a first embodiment. Initially with reference FIG. 2, a description is given of an overall configuration of the fixing device 20.

Figure 2:
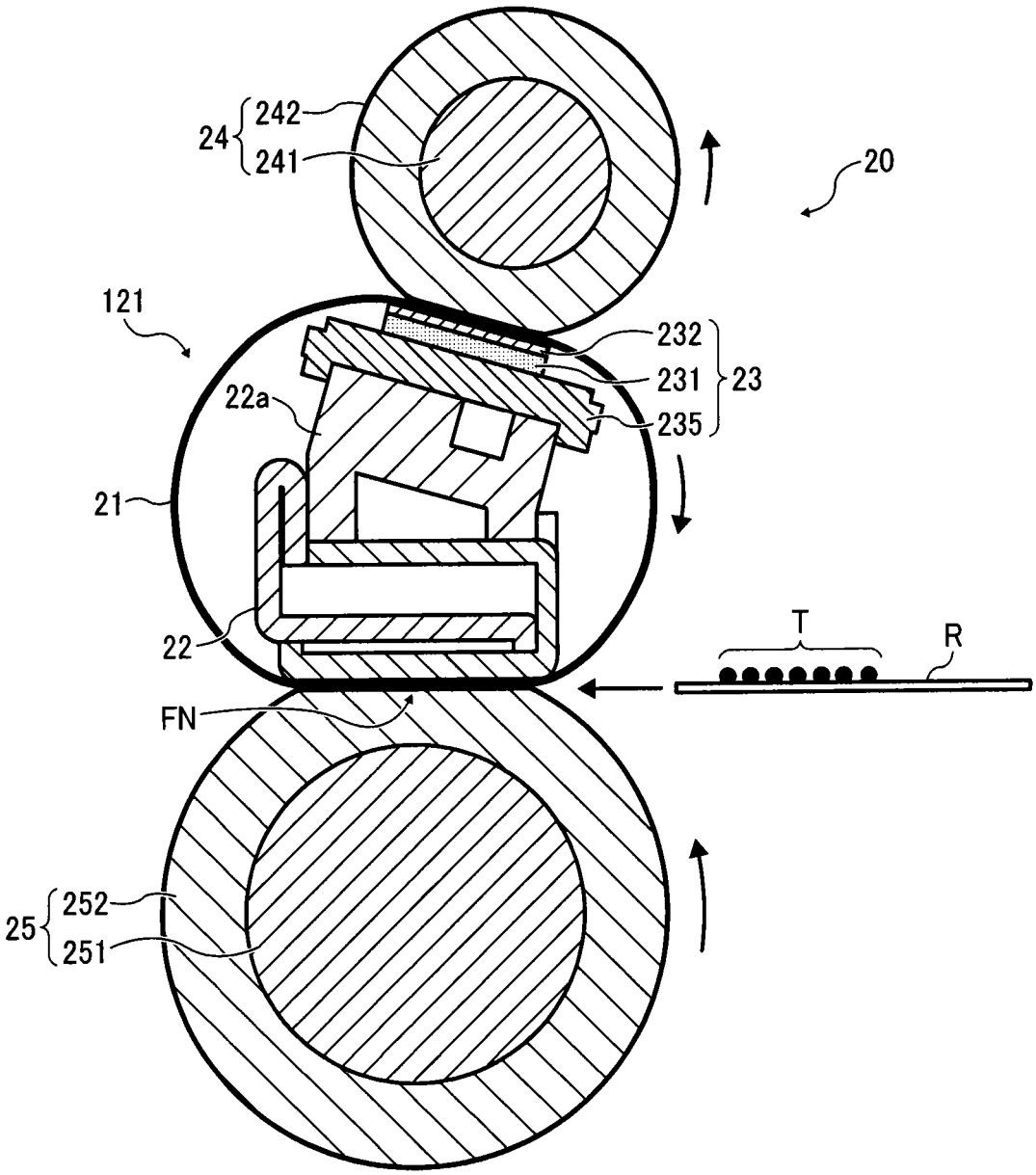
FIG. 2 is a schematic sectional view of a fixing device according to a first embodiment incorporated in the image forming apparatus of FIG. 1.

FIG. 2 is a schematic sectional view of the fixing device 20 according to the first embodiment, incorporated in the image forming apparatus 1 described above. As illustrated in FIG. 2, the fixing device 20 according to the first embodiment includes the fixing belt 21 serving as a first rotator, a stationary member 22, a base 22*a*, a heater 23 that directly contacts and heats the fixing belt 21, a pressure roller 24, and the pressing roller 25 serving as a second rotator. The fixing belt 21 and the components disposed inside a loop defined by the fixing belt 21, that is, the stationary member 22, the base 22*a*, and the heater 23 may constitute a belt unit 121 separably coupled with the pressure roller 24 and the pressing roller 25.

The fixing belt 21 is a thin, flexible, endless belt having a predetermined width, constructed of a base layer, an elastic layer, and a release layer resting in this order from an inner circumferential surface side thereof. The fixing belt 21 has a total thickness not greater than 1 mm. The base layer of the fixing belt 21 has a thickness of, e.g., about 30 μm to about 100 μm, and is made of a metal material, such as nickel or stainless steel, or a resin material such as polyimide.

The elastic layer of the fixing belt 21 has a thickness of, e.g., about 100 μm to about 300 μm, and is made of a rubber material such as silicon rubber, silicon rubber foam, or fluoro rubber. The elastic layer eliminates slight surface asperities of the fixing belt 21 in an area of contact between the pressing roller 25 and the fixing belt 21, herein called a fixing nip FN. Accordingly, heat is uniformly transmitted to a toner image T on the recording medium R, thereby suppressing formation of a rough image such as an orange peel image.

The release layer of the fixing belt 21 has a thickness of, e.g., about 10 μm to about 50 μm. The release layer is made of, e.g., tetrafluoroethylene-perfluoroalkylvinylether copolymer (PFA), polytetrafluoroethylene (PTFE), polyimide, polyetherimide, or polyether sulfide (PES). The release layer ensures releasability of the toner image T. In other words, the release layer reliably separates the toner image T from the fixing belt 21.

The stationary member 22 is a member having a substantially square bar shape. The stationary member 22 has a flat surface to form the fixing nip FN in concert with the pressing roller 25, described later. The stationary member 22 is positioned inside the loop defined by the fixing belt 21, and both ends of the stationary member 22 are supported by a frame of the fixing device 20. The stationary member 22 has another flat surface opposite the flat surface for forming the fixing nip FN, on which the base 22*a* is mounted to support the heater 23, described later.

Figure 3:
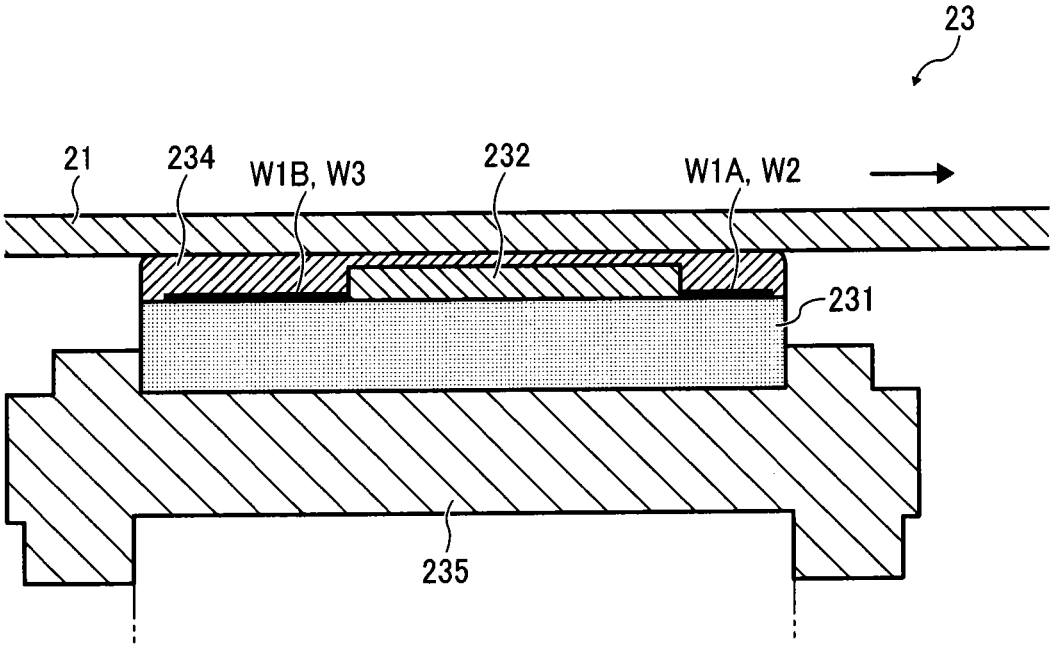
FIG. 3 is a sectional view of a heater incorporated in the fixing device of FIG. 2.

Referring now to FIG. 3, a detailed description is given of the heater 23.

FIG. 3 is a sectional view of the heater 23 incorporated in the fixing device 20 described above. The heater 23 is constructed of at least a substrate 231, a heat generator 232, and an overcoat layer 234. In this embodiment, the heater 23 also includes a holder 235. As illustrated in FIG. 3, the substrate 231 rests on the holder 235. The heat generator 232 rests on the substrate 231. The overcoat layer 234 coats the substrate 231 and the heat generator 232.

The substrate 231 has an elongated shape extending in an axial direction, that is, a width direction of the fixing belt 21. The substrate 231 is a glass substrate having print wiring on a surface facing the fixing belt 21. Wiring patterns of the print wiring are described later.

The heat generator 232 is a ceramic heater having an elongated planar shape. As illustrated in FIG. 3 and also in FIG. 4 referred to later, the heat generator 232 is disposed on the surface of the substrate 231 facing the fixing belt 21, at a position downstream in a rotational direction of the fixing belt 21. The heat generator 232 has a heat-generating area divided into a plurality of sub-heat-generating areas in the axial direction of the fixing belt 21 according to the wiring patterns of print wiring, described later.

Figure 4:
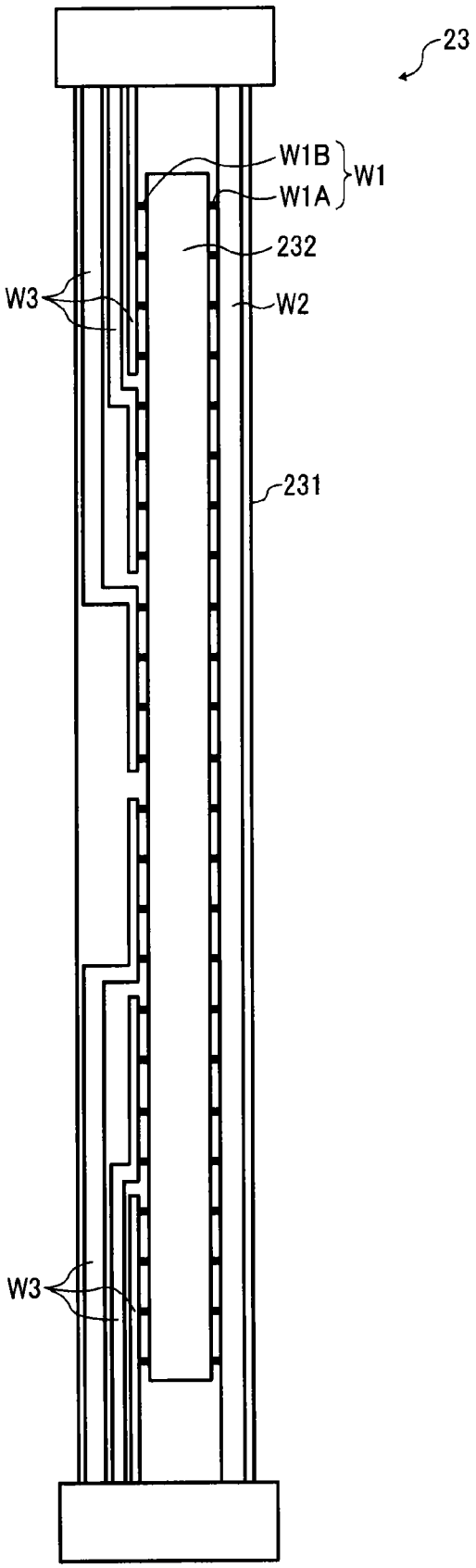
FIG. 4 is a plan view of the heater of FIG. 3, with a holder removed therefrom.

Referring now to FIG. 4, a detailed description is given of a first example of the wiring patterns of print wiring.

FIG. 4 is a plan view of the heater 23, with a holder removed therefrom, illustrating the first example of a wiring pattern. The first example of a wiring pattern for supplying power to the heat generator 232 includes a plurality of first conduction paths (connection terminals) W1, a second conduction path W2, and a plurality of third conduction paths W3.

The plurality of first conduction paths W1 are connected to both sides of the heat generator 232 in a lateral direction thereof, that is, the horizontal direction in FIG. 4, and aligned at a predetermined interval in a longitudinal direction of the heat generator 232, that is, the vertical direction in FIG. 4.

A description is now given of power supply to the heat generator 232 and grounding of the heat generator 232.

The substrate 231 has a planar shape elongated in the axial direction of the fixing belt 21. The fixing belt 21 moves along the overcoat layer 234 that covers the surface of the substrate 231 facing the fixing belt 21 out of two surfaces of the substrate 231, namely, front and back surfaces. The heat generator 232 is disposed in such a manner that the longitudinal direction thereof is along a longitudinal direction of the substrate 231. The respective longitudinal directions of the substrate 231 and the heat generator 232 correspond to the axial direction of the fixing belt 21. The respective lateral directions of the substrate 231 and the heat generator 232 correspond to the rotational direction of the fixing belt 21.

As illustrated in FIG. 4, the plurality of first conduction paths W1 are disposed on both sides of the heat generator 232 in the lateral direction thereof at a predetermined interval along the longitudinal direction of the heat generator 232.

The plurality of first conduction paths W1 include a plurality of first conduction paths W1A on one side of the heat generator 232 in the lateral direction thereof, and the plurality of first conduction paths W1B on the other side of the heat generator 232 in the lateral direction thereof. More specifically, the plurality of first conduction paths W1A are disposed downstream of the heat generator 232 in the rotational direction of the fixing belt 21 while the plurality of first conduction paths W1B are disposed upstream of the heat generator 232 in the rotational direction of the fixing belt 21. Power is supplied to the plurality of first conduction paths W1B, and the plurality of first conduction paths W1A are grounded. Thus, a circuit is configured to supply power to the heat generator 232. With such a configuration, the heat-generating area of the heat generator 232 generates heat.

In this embodiment, power is supplied to each unit of the plurality of first conduction paths W1 to heat the corresponding sub-heat-generating area. Each of the plurality of third conduction paths W3 is disposed to supply power to the corresponding unit of the plurality of first conduction paths W1. Thus, the plurality of third conduction paths W3 are disposed as a wiring pattern for power supply. The plurality of third conduction paths W3 are disposed on the surface of the substrate 231 facing the fixing belt 21, on one side of the heat generator 232 in the lateral direction thereof, and more specifically, upstream of the heat generator 232 in the rotational direction of the fixing belt 21.

The plurality of third conduction paths W3 are bidimentionally arranged side by side. Accordingly, the wiring pattern for power supply occupies a considerable area on the substrate 231, and more specifically, upstream of the heat generator 232 in the rotational direction of the fixing belt 21.

Thus, according to this embodiment, the plurality of third conduction paths W3 are disposed upstream of the heat generator 232 in the rotational direction of the fixing belt 21 to ensure a sufficient space, that is, a sufficient line width of wiring to dispose the heat generator 232 on the substrate 231, at a position downstream in the rotational direction of the fixing belt 21, that is, closer to the fixing nip FN.

As described above, the plurality of first conduction paths W1A are disposed on the surface of the substrate 231 facing the fixing belt 21, on one side of the heat generator 232 in the lateral direction thereof, and more specifically, downstream of the heat generator 232 in the rotational direction of the fixing belt 21. The plurality of first conduction paths W1A are grounded on a single elongated conduction path, that is, the second conduction path W2, and thus connected thereto. The second conduction path W2 extends in the longitudinal direction of the heat generator 232. The second conduction path W2 is disposed on the substrate 231, downstream of the heat generator 232 in the rotational direction of the fixing belt 21, as a grounding wiring pattern.

As described above, the plurality of first conduction paths W1A are commonly grounded on a single conduction path, that is, the second conduction path W2. Accordingly, the plurality of first conduction paths W1A are not necessarily controlled individually.

In this embodiment, all the plurality of first conduction paths W1A connected to the heat generator 232 and disposed downstream of the heat generator 232 in the rotational direction of the fixing belt 21 are grounded on the second conduction path W2.

Each of the plurality of first conduction paths W1A belongs to any one of the sub-heat-generating areas of the heat generator 232. In other words, the sub-heat-generating areas of the heat generator 232 are grounded via the plurality of first conduction paths W1A. Accordingly, the sub-heat-generating areas of the heat generator 232 are commonly grounded via the plurality of first conduction paths W1A on the single second conduction path W2.

The above-description is given of power supply to the heat generator 232 and grounding of the heat generator 232.

The first conduction paths W1B are connected to the plurality of third conduction paths W3. Specifically, each of the plurality of third conduction paths W3 is connected to a predetermined number of the first conduction paths W1B, which, in the example shown in FIG. 4, is four first conduction paths W1B. The plurality of third conduction paths W3 extend in the longitudinal direction of the heat generator 232. In the example shown in FIG. 4, three third conduction paths W3 are disposed upward from a center in the longitudinal direction of the heat generator 232. Similarly, three other third conduction paths W3 are disposed downward from the center in the longitudinal direction of the heat generator 232.

When a given third conduction path W3 of the plurality of third conduction paths W3 is supplied with power, an area of the heat generator 232 corresponding to the given third conduction paths W3 generates heat. Thus, the heat-generating area of the heat generator 232 is divided into a plurality of sub-heat-generating areas in the axial direction of the fixing belt 21.

According to the above-described first embodiment, one heat generator 232 is illustrated. Alternatively, a plurality of heat generators 232 may be linearly aligned and connected to the plurality of first conduction paths W1A, respectively. In such a case, the plurality of first conduction paths W1A may be commonly grounded on the conduction path W2. Alternatively, a thermal head may be used.

Referring back to FIG. 3, the overcoat layer 234 covers the substrate 231, the heat generator 232, the plurality of first conduction paths W1, the second conduction path W2 and the plurality of third conduction paths W3. Preferably, the overcoat layer 234 is made of a material having good heat conductivity.

As illustrated in FIG. 3, the holder 235 is a bar-like member having a substantially H-shaped cross-section to hold the substrate 231. The holder 235 is made of, e.g., a resin material having good heat resistance. As illustrated in FIG. 2, the base 22*a* engages a bottom of the holder 235. Accordingly, the heater 23 is coupled to the stationary member 22.

The pressure roller 24 is constructed of a metal core 241 and an elastic layer 242 covering the metal core 241. The elastic layer 242 is made of, e.g., silicon rubber foam, silicon rubber, or fluoro rubber.

The pressure roller 24 is rotatable, and configured to be pressed against the heater 23 to form an area of contact via the fixing belt 21, herein called a nip to transmit heat from the heat generator 232 to the fixing belt 21. Preferably, the elastic layer 242 is covered by a heat insulation layer made of a flexible, high-heat insulation material.

The heater 23 has the overcoat layer 234, as an outmost layer of the heater 23, slidably pressing an inner surface of the fixing belt 21. The heater 23 and associated components are disposed inside the loop defined by the fixing belt 21, thereby enhancing effective use of space. The overcoat layer 234 directly contacts the inner surface of the fixing belt 21. The contact area therebetween is a surface-contact area, which is larger than a point-contact area or a line-contact area. Accordingly, heat is transmitted from the heater 23 to the fixing belt 21 with relatively high heat conductivity.

The pressing roller 25 is constructed of a metal core 251, and an elastic layer 252 covering the metal core 251. The pressure roller 24 is rotatable, and configured to be pressed against the stationary member 22 via the fixing belt 21. Thus, a desired fixing nip FN is formed between the pressing roller 25 and the fixing belt 21.

The elastic layer 252 of the pressing roller 25 is made of, e.g., silicon rubber foam, silicon rubber, or fluoro rubber. Preferably, the elastic layer 252 is covered by a thin release layer made of, e.g., PFA or PTFE.

A description is now given of operation and effects of the fixing device 20 according to the first embodiment.

As described above, the toner image T formed on the recording medium R is fixed onto the recording medium R under heat and pressure applied by the fixing belt 21 and the pressing roller 25. Thus, a multicolor image is formed on the recording medium R. In the image forming apparatus 1 incorporating the fixing device 20 according to the first embodiment, the heat generator 232 has a plurality of sub-heat-generating areas for selectively generating heat. In other words, the image forming apparatus 1 incorporating the fixing device 20 according to the first embodiment can divide the recording medium R into an imaged area and a blank area according to image data, and only the imaged area is heated at a fixing temperature when the unfixed toner image T formed on the recording medium R is fixed onto the recording medium R.

Figure 5A:
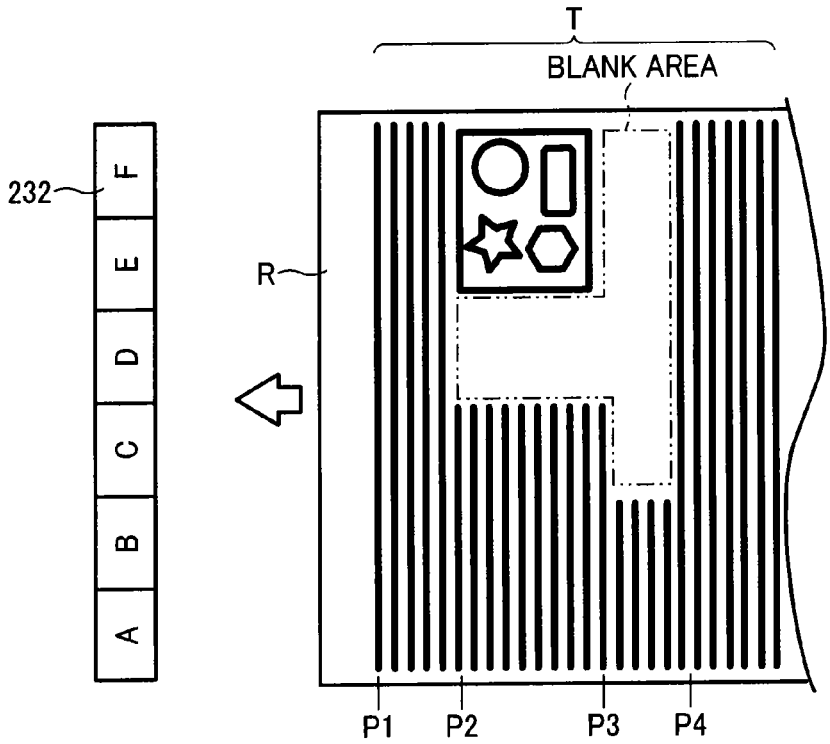
FIG. 5A is a plan view of a recording medium, illustrating an image formation pattern, with sub-heat-generating areas of a heat generator.
Figure 5B:
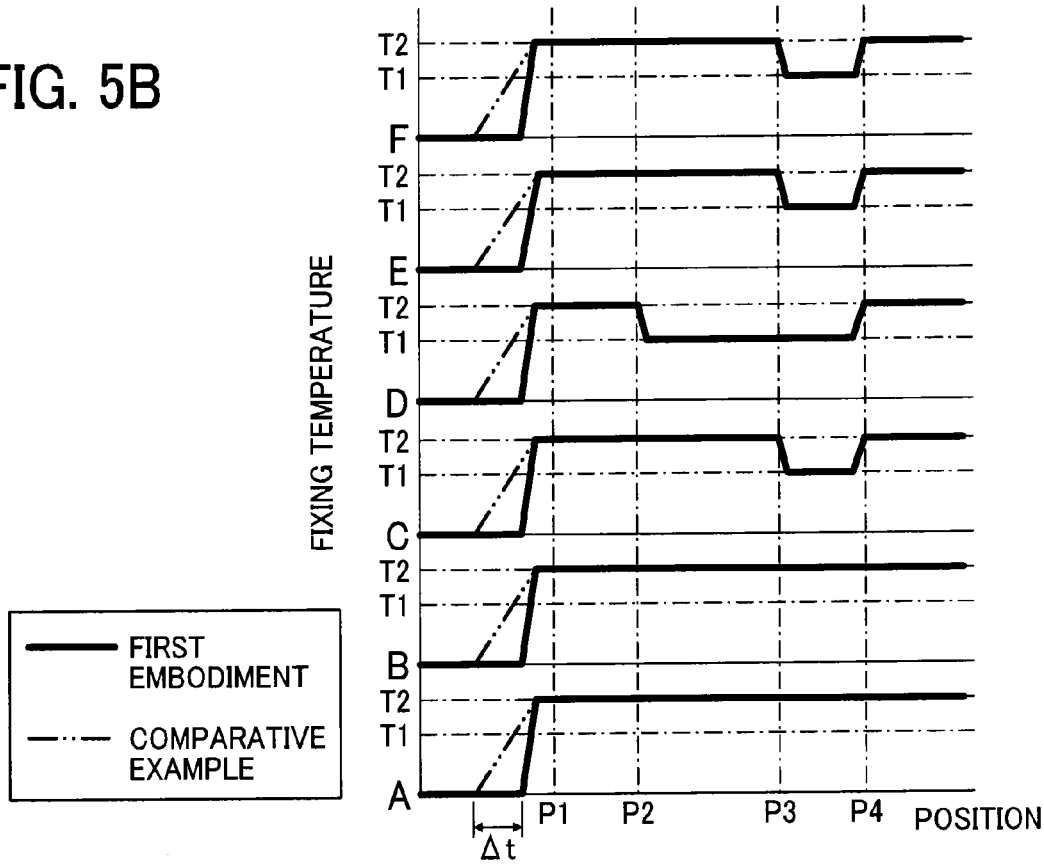
FIG. 5B is a graph of a relationship between the respective fixing temperatures of the sub-heat-generating areas and positions of the recording medium in a longitudinal direction thereof.

A specific example is illustrated in FIGS. 5A and 5B.

FIG. 5A is a plan view of a recording medium R, illustrating an image formation pattern, with a plurality of sub-heat-generating areas A through F of the heat generator 232. FIG. 5B is a graph of a relationship between the respective fixing temperatures of the sub-heat-generating areas A through F and positions of the recording medium R in a longitudinal direction thereof.

In this example, the unfixed toner image T of an image formation pattern including a blank area carried by the recording medium R illustrated in FIG. 5A is fixed under heat generated by the heat generator 232 having the plurality of sub-heat-generating areas A through F. Initially, the image forming apparatus 1 divides the recording medium R into an imaged area and a blank area according to the image data, and controls the plurality of sub-heat-generating areas A through F to achieve the respective fixing temperatures illustrated in FIG. 5B.

Specifically, an image is formed in an area between a position P1 and a position P2 in the longitudinal direction of the recording medium R across the width of the recording medium R. That is, the area between the position P1 and the position P2 is an imaged area. The image forming apparatus 1 supplies power to all the sub-heat-generating areas A through F, thereby controlling the respective fixing temperatures to reach a fixing temperature T2, which is a first target temperature. At this time, the power is supplied to the sub-heat-generating areas A through F so that the respective temperatures reach the fixing temperature T2 right before the position P1 of the recording medium R reaches the fixing nip FN.

An image is formed in an area between the position P2 and a position P3 in the longitudinal direction of the recording medium R across the width of the recording medium R, except for a blank area formed at a position corresponding to the sub-heat-generating area D. Accordingly, the image forming apparatus 1 supplies less power to the sub-heat-generating area D right after the position P2 of the recording medium R passes through the fixing nip FN, thereby lowering the fixing temperature of the sub-heat-generating area D to a preliminary heating temperature T1, which is a second target temperature. Accordingly, the startup time is shortened when the temperature is raised to a predetermined fixing temperature again.

Similarly, an image is formed in an area between the position P3 and a position P4 in the longitudinal direction of the recording medium R across the width of the recording medium R, except for a blank area formed at a position corresponding to the sub-heat-generating areas C through F. Accordingly, the image forming apparatus 1 supplies less power to the sub-heat-generating areas C, E, and F right after the position P3 of the recording medium R passes through the fixing nip FN while continuously supplying the less power to the sub-heat-generating area D, thereby lowering the fixing temperature of the sub-heat-generating areas C, E, and F to the second target temperature, that is, the preliminary heating temperature T1.

At a position P4, an image is formed in an area backward from the position P4 in a direction of conveyance, that is, a longitudinal direction of the recording medium R across the width of the recording medium R. In short, the area backward from the position P4 is an imaged area. The image forming apparatus 1 supplies power to all the sub-heat-generating areas A through F so that the respective fixing temperatures reach or maintain the first temperature, that is, the fixing temperature T2. At this time, the power is supplied to the sub-heat-generating areas A through F so that the respective temperatures reach or maintain the fixing temperature T2 right before the position P4 of the recording medium R reaches the fixing nip FN.

As described above, the image forming apparatus 1 incorporating the fixing device 20 according to the first embodiment supplies power to ensure that a sub-heat-generating area positioned corresponding to an imaged area is maintained at the fixing temperature T2, and that another sub-heat-generating area positioned corresponding to a blank area is maintained at the preliminary heating temperature T1, which is lower than the fixing temperature T2.

In the fixing device 20 according to the first embodiment, the heat generator 232 is disposed on the surface of the substrate 231 facing the fixing belt 21, and more specifically, at a position downstream in the rotational direction of the fixing belt 21. The elongated second conduction path W2 is a single conduction path on which the plurality of first conduction paths W1A are grounded. Such a simple grounding wiring pattern obviates a space necessary for a wiring pattern in which a plurality of conduction paths, such as the plurality of third conduction paths W3, are disposed in the rotational direction of the fixing belt 21. Accordingly, the wiring pattern of print wiring for supplying power to the heat generator 232 is grounded on the second conduction path W2 via the plurality of first conduction paths W1A disposed closer to the fixing nip FN.

With this wiring pattern, the distance between an edge of the heat generator 232 closer to the fixing nip FN and the edge of the substrate 231 closer to the fixing nip FN is shorter compared to a typical wiring pattern. Accordingly, an amount of heat absorbed from the fixing belt 21 is decreased during warm-up time.

For example, as illustrated in FIG. 5B, the power supply starts to heat the heat generator 232 so that the respective temperatures of the sub-heat-generating areas A through F reach the fixing temperature T1 right before the position P1 of the recording medium R reaches the fixing nip FN. Thus, the power supply in the fixing device 20 starts a time Δt later than the power supply in a fixing device according to a comparative example.

Thus, in the image forming apparatus 1 incorporating the fixing device 20 according to the first embodiment, the heat-generating area of the heat generator 232 is divided into a plurality of sub-heat-generating areas (e.g., sub-heat-generating areas A through F), and the heat generator 232 is located at a position downstream in the rotational direction of the fixing belt 21, that is, closer to the fixing nip FN, in an area of contact between the fixing belt 21 and the heater 23 incorporating the heat generator 232. Accordingly, the power consumption can be reduced and the warm-up time can be shortened.

Figure 6:
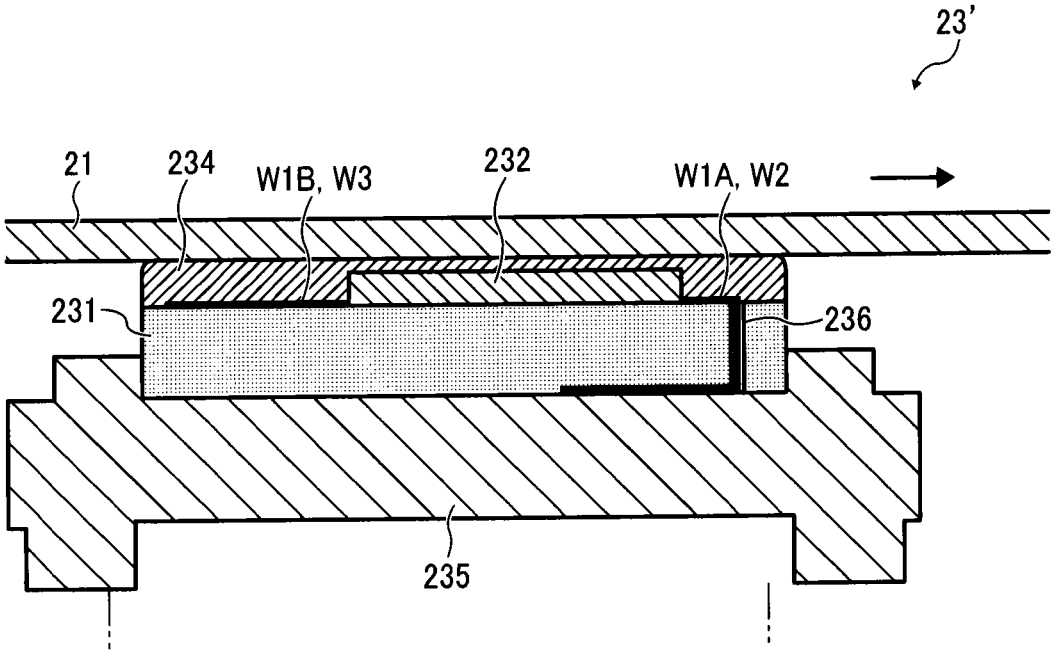
FIG. 6 is a sectional view of a heater.
Figure 7:
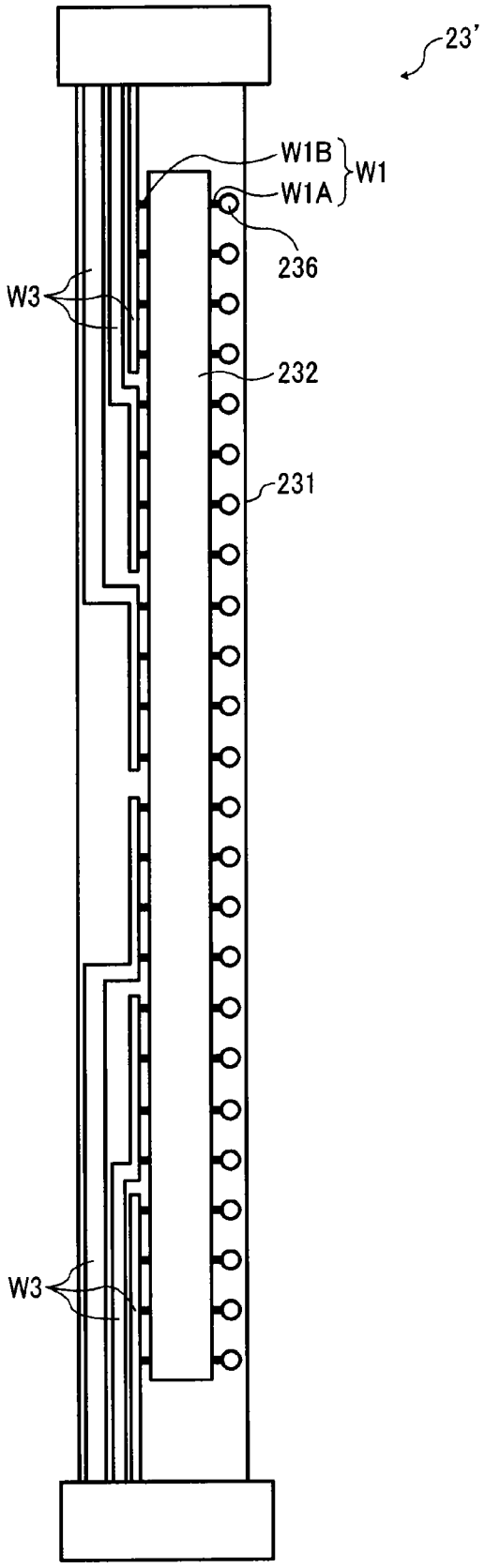
FIG. 7 is a plan view of the heater of FIG. 6, with a holder removed therefrom.

Referring now to FIGS. 6 and 7, a description is given of a second example of the wiring patterns of print wiring.

FIG. 6 is a sectional view of a heater 23'. FIG. 7 is a plan view of the heater 23', with the holder 235 removed therefrom, illustrating a second example of a wiring pattern.

According to the second example of a wiring pattern, a plurality of first conduction paths W1A are connected to the heat generator 232 and provided closer to the fixing nip FN to be grounded. Each of the plurality of first conduction paths W1A is wired on a backside of the substrate 231 via a through-hole 236. The plurality of first conduction paths W1A thus wired on the backside of the substrate 231 may be grounded on a single conduction path such as the second conduction path W2, or may be grounded on a plurality of conduction paths such as the plurality of third conduction paths W3.

The above-description is given of the fixing device 20 and the image forming apparatus 1 incorporating the fixing device 20. The image forming apparatus 1 incorporates the fixing device 20, but is not limited thereto. Alternatively, the image forming apparatus 1 may incorporate a fixing device 20S according to a second embodiment.

Figure 8:
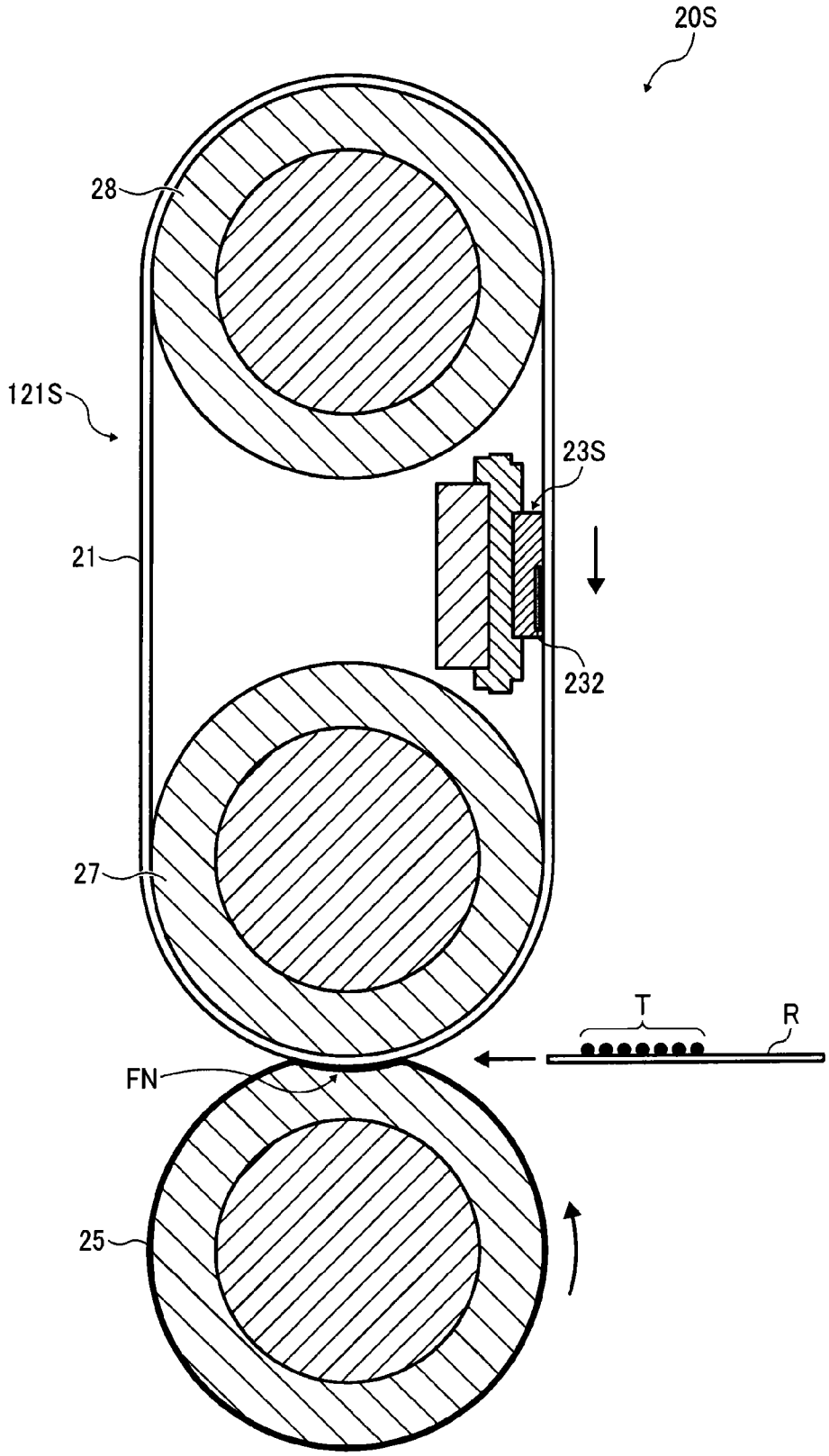
FIG. 8 is a schematic sectional view of a fixing device according to a second embodiment.

Referring now to FIG. 8, a description is given of the fixing device 20S according to the second embodiment.

FIG. 8 is a schematic sectional view of the fixing device 20S according to the second embodiment. The fixing device 20S includes a pair of rotatable rollers 27 and 28, an endless fixing belt 21 stretched over the pair of rotatable rollers 27 and 28, a pressing roller 25 pressed against the roller 27 to form an area of contact via the fixing belt 21, herein called a fixing nip FN. The fixing device 20S also includes a heater 23S incorporating a heat generator 232. As illustrated in FIG. 8, the heater 23S directly contacts and heats the fixing belt 21. The fixing belt 21 and the components disposed inside a loop defined by the fixing belt 21, that is, the pair of rotatable rollers 27 and 28, and the heater 23S, may constitute a belt unit 121S separably coupled with the pressing roller 25.

The above-described wiring patterns of print wiring are also applicable to the heater 23S incorporated in the fixing device 20S.

Alternatively, the image forming apparatus 1 may incorporate a fixing device 20T according to a third embodiment, or a fixing device 20U according to a fourth embodiment.

Figure 9:
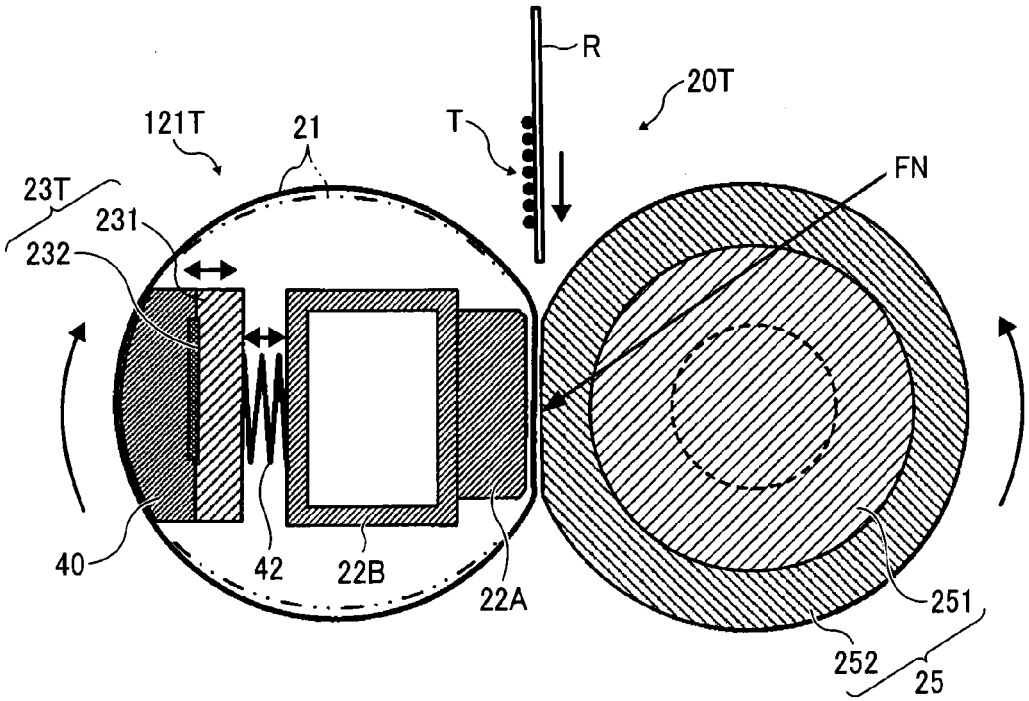
FIG. 9 is a schematic sectional view of a fixing device according to a third embodiment.

Referring now to FIG. 9, a description is given of the fixing device 20T according to the third embodiment.

FIG. 9 is a schematic view of the fixing device 20T according to the third embodiment. The fixing device 20T has a configuration similar to that of the fixing device 20 and that of the fixing device 20S as below. Differently from the fixing devices 20 and 20S, the fixing device 20T includes a curved-surface member 40 and an elastic member 42. The curved-surface member 40 is interposed between an endless fixing belt 21 and a heater 23T, thereby serving as an intermediate member. In short, the heater 23 indirectly contacts the fixing belt 21 via the curved-surface member 40.

The fixing device 20T includes the fixing belt 21 serving as a first rotator, the heater 23T to heat the fixing belt 21, and a pressing roller 25 serving as a second rotator pressed against the fixing belt 21 to form an area of contact herein called a fixing nip FN. The fixing device 20T also includes a stationary member 22A, a base 22B, the curved-surface member 40 and the elastic member 42. The fixing belt 21 and the components disposed inside a loop defined by the fixing belt 21, that is, the stationary member 22A, the base 22B, the heater 23T, the curved-surface member 40, and the elastic member 42, may constitute a belt unit 121T separably coupled with the pressing roller 25.

While a recording medium R carrying an unfixed toner image T thereon passes through the fixing nip FN, the toner image T is fixed onto the recording medium R under heat and pressure.

The heater 23T includes, e.g., an elongated substrate 231 extending in an axial direction of the fixing belt 21, and a heat generator 232.

The heat generator 232 is disposed on a surface of the substrate 231 facing the fixing belt 21, and more specifically, at a position downstream in a rotational direction of the fixing belt 21. The heat generator 232 has a heat-generating area divided into a plurality of sub-heat-generating areas in the axial direction of the fixing belt 21.

The heater 23T also includes electrical conduction paths connected to the individual sub-heat-generating areas of the heat generator 232 and disposed on the surface of the substrate facing the fixing belt 21. The sub-heat-generating areas of the heat generator 232 are commonly grounded on a single electrical conduction path via a plurality of electrical conduction paths disposed downstream of the heat generator 232 in the rotational direction of the fixing belt 21.

The pressing roller 25 is constructed of a metal core 251, and an elastic layer 252 covering the metal core 251.

In this embodiment, a pressure roller such as the pressure roller 24 incorporated in the fixing device 20 according to the first embodiment may be omitted. Instead of using the pressure roller 24, the curved-surface member 40 and the elastic member 42 are used in this embodiment. The curved-surface member 40 is disposed inside the loop defined by the fixing belt 21. The elastic member 42 presses the curved-surface member 40 so that the curved-surface member 40 contacts the inner surface of the fixing belt 21.

The curved-surface member 40, serving as an intermediate member, has a pillar shape and a length equal to, or substantially equal to the length of the heater 23T, extending in the rotational direction of the fixing belt 21. The curved-surface member 40 has a curved surface that conforms to the shape of the inner surface of the fixing belt 21, thereby evenly adhering to a curved surface of a cylindrical shape of the fixing belt 21.

The curved-surface member 40 has a contact surface opposite the curved surface. The heater 23T is fixed to the contact surface of the curved-surface member 40.

The heater 23T includes an overcoat layer 234 in addition to the substrate 231 and the heat generator 232. The overcoat layer 234 covers one side of the heat generator 232. An opposite side of the heat generator 232 is coupled to the substrate 231, as illustrated in FIG. 3 or FIG. 6. Thus, the heater 23T and the curved-surface member 40 are coupled to each other via the overcoat layer 234.

In this embodiment, the heater 23T does not include a holder, such as the holder 235. Accordingly, the elastic member 42 contacts and presses the substrate 231 as illustrated in FIG. 9. Alternatively, the heater 23T may include the holder. In such a case, the substrate 232 is coupled to the holder, and the elastic member 42 contacts and presses the holder.

Thus, the curved-surface member 40 and the heater 23T are coupled to each other with the heat generator 232 enclosed therein at the contact portion of the curved-surface member 40 and the heater 23T. The curved-surface member 40 is made of metal. Preferably, the curved-surface member 40 is made of a metal material having good heat conductivity and easy to be heated, such as aluminum having low specific heat.

The stationary member 22A is pressed by the pressing roller 25 via the fixing belt 21, thereby forming the fixing nip FN. The stationary member 22A has a shape substantially the same as the stationary member 22 illustrated in FIG. 2. The stationary member 22A is positioned inside the loop defined by the fixing belt 21, extending in the axial direction of the fixing belt 21. Both ends of the stationary member 22A are supported by a frame of the fixing device 20T.

The base 22B is coupled to a surface of the stationary member 22A opposite a surface facing the fixing nip FN. The base 22B has a rectangular, square-tube shape. The base 22B faces the heater 23T. The elastic member 42 is interposed between the base 22B and the heater 23T to separate the heater 23T from the base 22B. In this embodiment, an extensible spring is used as the elastic member 42.

The elastic member 42 has an end that presses an outermost part of the heater 23T that is, the substrate 231 in this case. The elastic member 42 presses the heater 23T with its elastic force so that the curved-surface member 40 closely contacts the fixing belt 21. Thus, the overcoat layer 234 of the heater 23T indirectly contacts the fixing belt 21 via the curved-surface member 40.

The fixing belt 21 is made of a material described above, and has elasticity, rigidity, and tension. The elastic member 42 applies its force in a direction in which the fixing belt 21 is extended.

The overcoat layer 234 is a thin layer that protects the heat generator 232. The curved-surface member 40 interposed between the heater 23T and the fixing belt 21 has a curved-surface that conforms to the curvature of the fixing belt 21.

A rotational force of the fixing belt 21 is given by a torque of the pressing roller 25, using a frictional force between an elastic layer 252 of the pressing roller 25 and the fixing belt 21.

For example, the fixing belt 21 having a perfect round shape without receiving any external force is slightly deformed into an elliptical shape by the elastic member 42, thereby keeping its balance with the force of the elastic member 42. A pressing force of the curved-surface member 40 against the fixing belt 21 can be adjusted to prevent an excessive torque of the pressing roller 25 from stopping rotation of the fixing belt 21. For example, the spring used as the elastic member 42 may be replaced with another spring having a different elastic modulus.

The curved-surface member 40 and the heater 23 are together displaced by an action of the elastic member 42. A guide member may be provided to determine a direction of the displacement for a smooth movement.

The curved-surface member 40 closely contacts and slides on the cylindrical inner surface of the fixing belt 21 to transmit heat from the heater 23 to the fixing belt 21. The rotatable fixing belt 21 and the pressing roller 25 convey the recording medium R through the fixing nip FN, in which the toner image T formed on the recording medium R is fixed onto the recording medium R.

The above-described wiring patterns of print wiring are also applicable to the heater 23T incorporated in the fixing device 20T.

Figure 10:
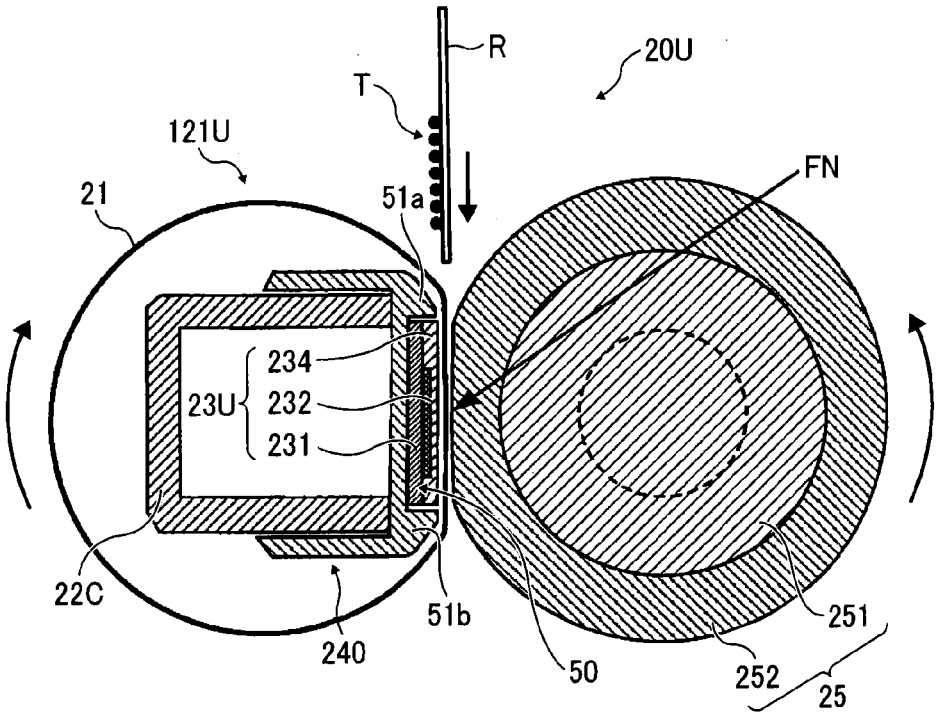
FIG. 10 is a schematic sectional view of a fixing device according to a fourth embodiment.

Referring now to FIG. 10, a description is given of the fixing device 20U according to the fourth embodiment.

FIG. 10 is a schematic view of the fixing device 20U according to the fourth embodiment. In the fixing devices 20, 20S and 20T described above, the heater 23, 23S and 23T are disposed away from the fixing nip FN, respectively. In the fixing device 20U, a heater 23U is disposed facing a fixing nip FN. The fixing device 20U has a configuration similar to those of the fixing devices 20, 20S and 20T described above.

The fixing device 20U includes an endless fixing belt 21 serving as a first rotator, a heater 23U that directly contacts and heats the fixing belt 21, and a pressing roller 25 serving as a second rotator pressed against the fixing belt 21 to form an area of contact herein called a fixing nip FN. The fixing device 20U also includes a stationary member 22C and a holder 240 that holds the heater 23U. The fixing belt 21 and the components disposed inside a loop defined by the fixing belt 21, that is, the stationary member 22C, the heater 23U, and the holder 240, may constitute a belt unit 121U separably coupled with the pressing roller 25.

While a recording medium R carrying an unfixed toner image T thereon passes through the fixing nip FN, the toner image T is fixed onto the recording medium R under heat and pressure.

The heater 23U has an elongated planner shape and includes, e.g., an elongated substrate 231 extending in an axial direction of the fixing belt 21, a heat generator 232, and an overcoat layer 234.

The heat generator 232 is disposed on a surface of the substrate 231 facing the fixing belt 21, and more specifically, at a position downstream in a rotational direction of the fixing belt 21. The heat generator 232 has a heat-generating area divided into a plurality of sub-heat-generating areas in the axial direction of the fixing belt 21.

The overcoat layer 234 covers the substrate 231, the heat generator 232, and the electrical conduction paths.

The heater 23U also includes electrical conduction paths connected to the individual sub-heat-generating areas of the heat generator 232 and disposed on the surface of the substrate facing the fixing belt 21. The sub-heat-generating areas of the heat generator 232 are commonly grounded on a single electrical conduction path via a plurality of electrical conduction paths disposed downstream of the heat generator 232 in the rotational direction of the fixing belt 21.

The pressing roller 25 is constructed of a metal core 251, and an elastic layer 252 covering the metal core 251.

A stationary member 22C is a rigid member having a grooved shape, and disposed inside a loop defined by the fixing belt 21, extending in the axial direction of the fixing belt 21. Both ends of the stationary member 22C are supported by a frame of the fixing device 20U. End surfaces of the stationary member 22C facing the pressing roller 25 are coupled to the holder 240. The holder 240 supports the stationary member 22C at both ends in the rotational direction of the fixing belt 21.

The holder 240 is coupled to the stationary member 22C with a back surface thereof facing the pressing roller 25. The back surface of the holder 240 has a recessed portion 50 extending in the axial direction of the fixing belt 21. The heater 23U is disposed in the recessed portion 50 of the holder 240. The heater 23U has an elongated planar shape and includes, e.g., the substrate 231, the heat generator 232, the overcoat layer 234, and electric conduction paths as described above.

The pressing roller 25 is pressed against the overcoat layer 234 via the fixing belt 21 to form the fixing nip FN. The stationary member 22C supports a pressing force applied by the pressing roller 25 in the fixing nip FN.

The heater 23 faces the fixing nip FN and is supported in the recessed portion 50 of the holder 240. Alternatively, the recessed portion 50 may directly hold the substrate 231. The holder 240 has shoulders 51*a* and 51*b* formed on both sides of the recessed portion 50 and chamfered along the rotational direction of the fixing belt 21 to support and smoothly rotate the fixing belt 21.

A rotational force of the fixing belt 21 is given by a torque of the pressing roller 25, using a frictional force between the elastic layer 252 of the pressing roller 25 and the fixing belt 21. An unsupported portion of the fixing belt 21 may be supported by a support member.

The fixing belt 21 is heated by heat applied by the heater 23 in the fixing nip FN. The rotatable fixing belt 21 and the pressing roller 25 convey the recording medium R through the fixing nip FN, in which the toner image T formed on the recording medium R is fixed onto the recording medium R.

The above-described wiring patterns of print wiring are also applicable to the heater 23U incorporated in the fixing device 20U.

The present invention, although it has been described above with reference to specific exemplary embodiments, is not limited to the details of the embodiments described above, and various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of this invention. The number of constituent elements and their locations, shapes, and so forth are not limited to any of the structure for performing the methodology illustrated in the drawings.

What is claimed is:

1. A fixing device for fixing an unfixed toner image formed on a recording medium onto the recording medium under heat and pressure in a fixing nip, the fixing device comprising:

a first rotator;

a second rotator pressed against the first rotator to form the fixing nip; and a heater to contact and heat the first rotator, the heater including:

an elongated substrate extending in an axial direction of the first rotator;

a heat generator disposed on a surface of the substrate facing the first rotator, at a position downstream in a rotational direction of the first rotator;

a plurality of first conduction paths connected to the heat generator and grounded downstream of the heat generator in the rotational direction of the first rotator;

a second conduction path on which the plurality of first conduction paths are grounded;

a plurality of third conduction paths to supply power to the heat generator, each of the plurality of third conduction paths disposed upstream of the heat generator in the rotational direction of the first rotator, the plurality of third conduction paths includes three separate electrical conduction paths that each include a portion that is parallel and overlapping with portions of the others of the three separate electrical conduction paths, and the parallel and overlapping portions of the three separate electrical conduction paths overlap in a direction perpendicular to the axial direction; and a plurality of intermediate power supply conduction paths disposed upstream of the heat generator in the rotational direction of the first rotator, each of the plurality of third conduction paths connected to the heat generator through a corresponding group of the plurality of intermediate power supply conduction paths, the heat generator has a heat-generating area divided into a plurality of sub-heat-generating areas in the axial direction of the first rotator, the plurality of sub-heat-generating areas grounded on the second conduction path via the plurality of first conduction paths.

2. The fixing device according to claim 1, further including an intermediate member interposed between the first rotator and the heater, wherein the heater contacts the first rotator via the intermediate member.

3. The fixing device according to claim 1, wherein the first rotator defines a loop, and the heater is disposed inside the loop to contact an inner surface of the first rotator.

4. An image forming apparatus comprising the fixing device according to claim 1.

5. A fixing device for fixing an unfixed toner image formed on a recording medium onto the recording medium under heat and pressure in a fixing nip, the fixing device comprising:

a first rotator;

a second rotator pressed against the first rotator to form the fixing nip; and a heater to contact and heat the first rotator, the heater including:

an elongated substrate extending in an axial direction of the first rotator;

a heat generator disposed on a surface of the substrate facing the first rotator, at a position downstream in a rotational direction of the first rotator; and a plurality of conduction paths connected to the heat generator and grounded downstream of the heat generator in the rotational direction of the first rotator;

a plurality of power supply conduction paths to supply power to the heat generator, each of the plurality of power supply paths disposed upstream of the heat generator in the rotational direction of the first rotator, the plurality of power supply paths includes three separate electrical conduction paths that each include a portion that is parallel and overlapping with portions of the others of the three separate electrical conduction paths, and the parallel and overlapping portions of the three separate electrical conduction paths overlap in a direction perpendicular to the axial direction; and a plurality of intermediate power supply conduction paths disposed upstream of the heat generator in the rotational direction of the first rotator, each of the plurality of power supply conduction paths connected to the heat generator through a corresponding group of the plurality of intermediate power supply conduction paths, the elongated substrate including a plurality of through-holes, the heat generator has a heat-generating area divided into a plurality of sub-heat-generating areas in the axial direction of the first rotator, the plurality of conduction paths wired on a backside of the elongated substrate via the through-holes and grounded.

6. The fixing device according to claim 5, further including an intermediate member interposed between the first rotator and the heater, wherein the heater contacts the first rotator via the intermediate member.

7. The fixing device according to claim 5, wherein the first rotator defines a loop, and the heater is disposed inside the loop to contact an inner surface of the first rotator.

8. An image forming apparatus comprising the fixing device according to claim 5.

9. The fixing device according to claim 1, wherein the plurality of third conduction paths each extend a different distance in the direction perpendicular to the axial direction.

10. The fixing device according to claim 1, wherein the parallel and overlapping portions of the three separate electrical conduction paths each include a different thickness in the direction perpendicular to the axial direction.

* * * * *